US010199755B2

(12) United States Patent
Lieber

(10) Patent No.: US 10,199,755 B2
(45) Date of Patent: Feb. 5, 2019

(54) ELECTRICAL CONNECTIVE DEVICE

(71) Applicant: Clarence Alan Lieber, Wichita, KS (US)

(72) Inventor: Clarence Alan Lieber, Wichita, KS (US)

( * ) Notice: Subject to any disclaimer, the term of this patent is extended or adjusted under 35 U.S.C. 154(b) by 0 days.

(21) Appl. No.: 15/625,354

(22) Filed: Jun. 16, 2017

(65) Prior Publication Data

US 2017/0365941 A1 Dec. 21, 2017

Related U.S. Application Data

(60) Provisional application No. 62/351,353, filed on Jun. 17, 2016.

(51) Int. Cl.

| | |
|---|---|
| ***H01R 12/70*** | (2011.01) |
| ***H01R 13/405*** | (2006.01) |
| ***H01R 13/10*** | (2006.01) |
| ***H01R 31/06*** | (2006.01) |
| ***H01R 24/86*** | (2011.01) |
| *H01R 105/00* | (2006.01) |
| *H01R 13/20* | (2006.01) |

(52) U.S. Cl.

CPC ..... *H01R 12/7058* (2013.01); *H01R 13/10* (2013.01); *H01R 13/405* (2013.01); *H01R 24/86* (2013.01); *H01R 31/06* (2013.01); *H01R 13/20* (2013.01); *H01R 2105/00* (2013.01)

(58) Field of Classification Search

CPC ..... H01R 13/7195; H01R 13/719; H01R 13/6625; H01R 13/10

See application file for complete search history.

(56) References Cited

U.S. PATENT DOCUMENTS

| | | | | |
|---|---|---|---|---|
| 5,951,321 A * | 9/1999 | Jaag | H01R 4/2429 439/405 |
| 6,488,539 B1 * | 12/2002 | Turek | H01R 4/2454 439/620.21 |
| 8,292,665 B2 * | 10/2012 | D'Amico | H01R 4/64 439/620.09 |
| 2003/0171024 A1 * | 9/2003 | Mossner | H01R 4/2433 439/404 |
| 2007/0134985 A1 * | 6/2007 | Frysz | H01R 13/719 439/620.09 |

* cited by examiner

*Primary Examiner* — Briggitte R Hammond
(74) *Attorney, Agent, or Firm* — Daniel Zamudio

(57) ABSTRACT

An apparatus that is used to enclose and stack electrical components in varying configurations. The configurations are achieved by easily manipulating the way the apparatus is stacked. The stacking of apparatus' is achieved easily, and with little cost in manufacturing.

8 Claims, 4 Drawing Sheets

ELECTRICAL CONNECTIVE DEVICE

BACKGROUND

The science of electronics continues to advance, neutrinos and shape shifting are all the rage. Along with continued advances in the subatomic characteristics of electronics remains the practical side of turning these advances into useful technologies. Regardless of these tiny particles, there still remains a need for printed circuit boards, electrical connectors, and components like transistors, resistors, and capacitors.

The components are generally laid along a predetermined circuitry and connected into place on a printed circuit board. One can look at a circuit board and see how the components are combined, often in such a way as to prevent further configuration. Combining two or more of the components is done piecemeal.

Electrical components, such as capacitors for example, often need to be configured with other like or similar components to make a circuit function as desired. For instance, two capacitors might need be connected to form a series circuit, or a parallel circuit and often in differing sizes. Doing this today is cumbersome and not cost effective.

There is a need in the industry for an apparatus that is easy to use, inexpensive, and assists in allowing the use of an electrical component by itself while also allowing for combining two or more components together. An apparatus that can, for example, allow two different capacitors to be used in parallel, as a dual, in series or separately by merely altering the position of the apparatus.

SUMMARY

The present invention is directed to an apparatus that satisfies this need. The apparatus is a novel connective device comprising a container. The container is made from a durable material such as plastic or the like. A terminal is located mostly within the container and has a male end and a female end. There is a joining portion that is part of the terminal. The joining portion is capable of being connected to an electrical component, a capacitor to name one example of such a component. The male end protrudes above the boundary of the container and the female end is located sufficiently within the boundaries of the container. Though the ends can be positioned in or out of the container, these are the best configurations. The container has at least two terminals located within the container that are equally spaced apart within the container. The terminals are situated generally along an axis of the container. A first container being stackable with a second container allows the female end of the first container to engage the male end of the second container. The container is rotatable to form a different connection configuration of containers.

The apparatus is used to make it easier to configure components. Connecting more than one apparatus together in different relative positions, achieved by rotating one in relation to the other, a different circuit is achieved.

Another embodiment of the device for use in electrical and electronic circuits comprises a container. The container is best if shaped like a miniature hockey puck though any shape or size is possible. Often, the size is determined by the electrical components involved.

It is preferred that the container is made from a plastic ABS material, but any material can be used that is suitable. Preferred is this cylindrical shape with flat top and bottom. There are a plurality of connectors, terminal like conducting pieces. Preferably the connectors are one solid piece of electrically conductive material, such as copper to name one example. Each of the connectors has a first portion and a second portion. I envision the first portion being a male and the second portion being a female type connector. Commonly known in the industry are quick connect terminals. The connectors have a body portion as well. The container houses the body portions while the first portion extends beyond the boundary of the container and the second portion works best when it does not extend beyond the boundary of the container.

It is envisioned that the first portion would stick out from the container. The second portions are generally flush with the boundary of the container on the opposite side. Best suited for this configuration is a male type first portion and a female type second portion.

Electrical circuitry is connected to the body portions of at least two of the plurality of connectors. So, for example, a capacitor is soldered to the body portion of one connector and soldered to the body portion of another connector.

I have determined that the connectable nature of the device works best when the plurality of connectors are relatively equidistant from one another and relatively perpendicular to one another. The device is connectable to one or more other devices via their respective plurality of connectors. This connection can be done in any feature allowed by the configuration of connectors.

More specifically with respect to the connectors, an embodiment of the device can have three ¼" blade quick connect terminals, male at one end and female at the other end. Two of these terminals are for an electronic circuit component, such as a capacitor, and the third is used as a connection for a another device if one exists. These three blades shall protrude from the top of the device and ideally be at 120 degrees from each other, measured center to center. Two devices may be connected together via these quick connect terminals, i.e. male to female ends. It is envisioned that the terminals can be configurable by a user so as to make the position of the terminals selectable by the user.

In another embodiment of the apparatus a mounting mechanism is used to attach the device to an external circuit such as a printed circuit board. Possible mechanisms include use of an unused connector as a metal tab mounting bracket or a tab molded as part of the housing, however, the devices must remain stackable.

In another embodiment of the apparatus the initial voltage support shall be 370 or 440. The apparatus contains informational markings on the device. The container must allow for heat dispersion so as not to interfere with the encased electronic component functionality.

In yet another embodiment of the device, where the electrical component that is part of the device is a capacitor, capacitances supported are 2.5, 5, 10, 20, and 40 μF. In such an embodiment, by using non-polarized capacitors the apparatus can be configured for one capacitor by itself, two capacitors in parallel, two capacitors in series, or two capacitors separated.

BRIEF DESCRIPTION OF THE SEVERAL VIEWS OF THE DRAWINGS

These and other features, aspects and advantages of the present invention will become better understood with regard to the following description, appended claims, and accompanying drawing where:

DESCRIPTION

Overview.

Figure 1:
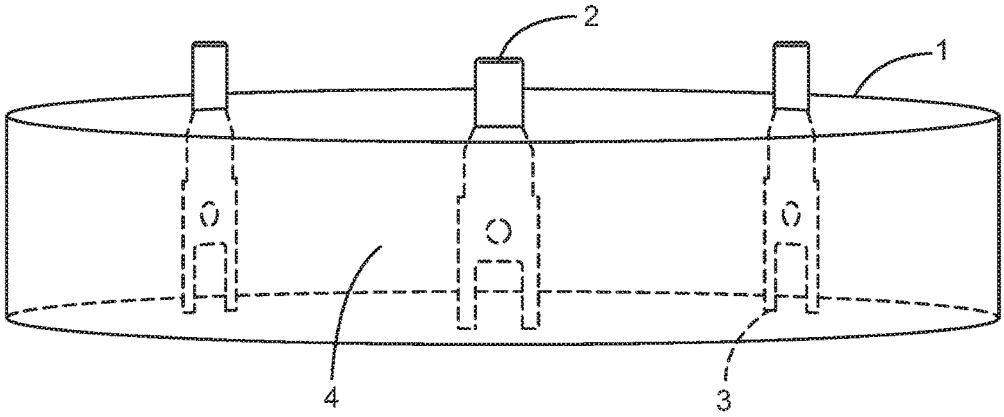
FIG. 1 shows a perspective view of one embodiment of the present invention.

As shown in FIG. 1, one embodiment of the present invention a container 1 is cylindrical. The container 1 has enclosed within its boundaries a plurality of terminals 4. The terminals having a male end 2 and a female end 3.

Figure 2:
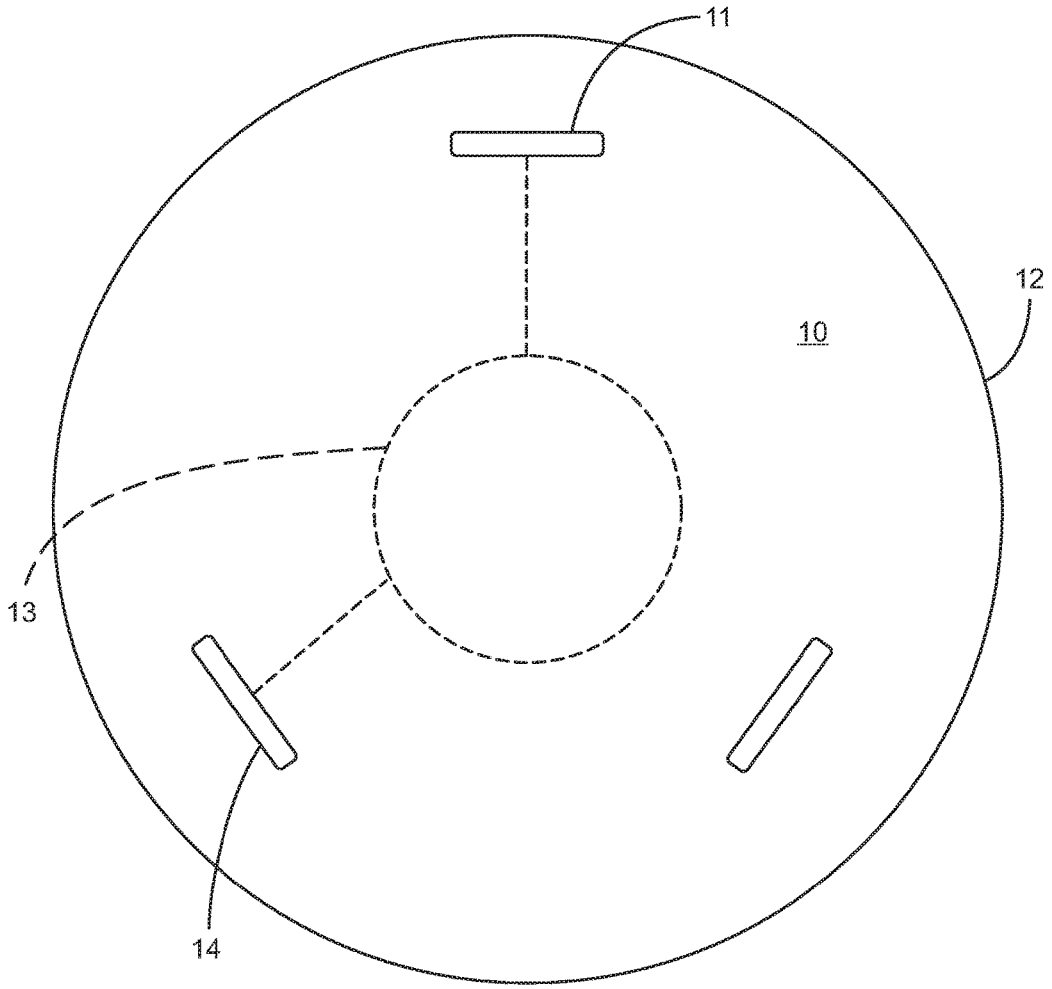
FIG. 2 shows a bottom side view of another embodiment of the present invention.

As shown in FIG. 2, another embodiment of the present invention a container 12 has a bottom side 10. An electrical component 13 is attached between two terminals 11 and enclosed within the container 12. The female ends 14 of the terminals 11 are positioned equidistant from one another.

Figure 3:
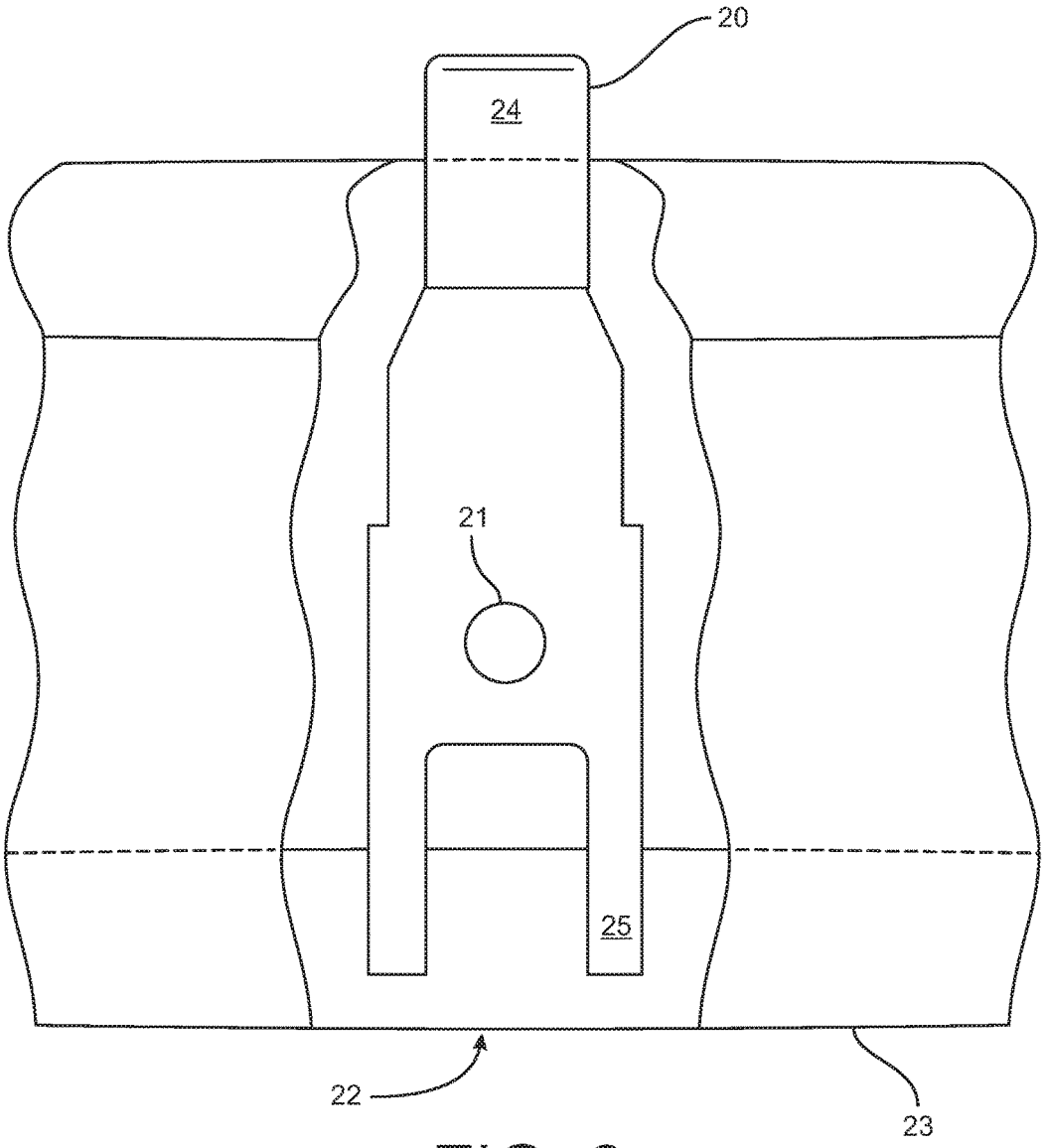
FIG. 3 shows a perspective view of another embodiment of the present invention with a cutaway view.

As shown in FIG. 3, another embodiment of the present invention a container 23 has a cutaway view showing the terminal 20 enclosed within. The terminal 20 has a male end 24 and a female end 25. A connecting segment 21 is shown positioned between the male end 24 and the female end 25.

Figure 4:
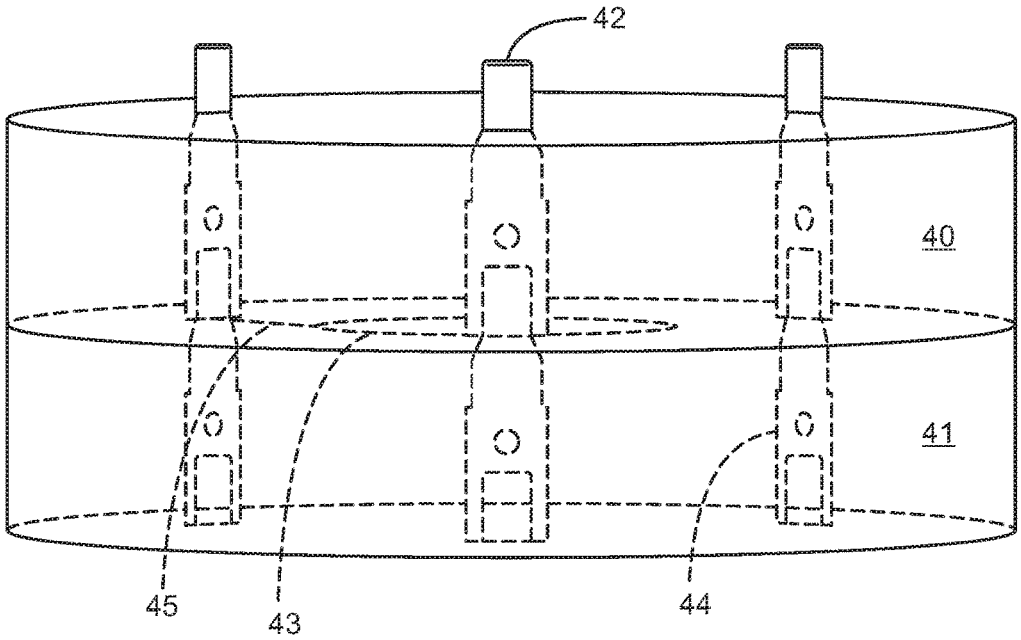
FIG. 4 shows a perspective view of another embodiment of the present invention.

As shown in FIG. 4, another embodiment of the present invention a primary container 40 is stacked on top of a secondary container 41. The terminals being connected so as to form one continuous conductive piece 44. The male end of the terminals 42 protrude above the boundary of the primary container 40. An electrical component 43, like a capacitor, is connected between two terminals 44 at a connecting segment 45 of the terminals 44.

Although the present invention has been described in considerable detail with the reference to certain preferred versions thereof, other versions are possible. Therefore, the spirit and scope of the appended claims should not be limited to the description of the preferred versions contained herein. For instance, the first or second portions may be oriented relative to the container such that they are accessible from without the container but not necessarily extending beyond the boundary of the container.

Any element in a claim that does not explicitly state "means for" performing a specified function, or "step for" performing a specific function, is not to be interpreted as a "means" or "step" clause as specified in 35 U.S.C. § 112, ¶ 6.

What I claim is:

1. An electrical connective device for use in electronic circuits, the device comprising:

(a) a container;
(b) a plurality of connectors;
(c) each of the plurality of connectors having a first portion, each first portion being one of a male connection or a female connection;
(d) each of the plurality of connectors having a second portion, each second portion being the other one of a male connection or a female connection, each second portion configured to connect directly to a first portion;
(e) each of the plurality of connectors having a body portion;
(f) the container enclosing the body portions;
(g) the first portions extending beyond a boundary of the container;
(h) the second portions extending to be flush with the boundary of the container;
(i) electrical circuitry being connected to the body portions of at least two of the plurality of connectors.

2. The device of claim 1 wherein the electrical circuitry is a capacitor.

3. The device of claim 1 wherein the container is relatively round.

4. The device of claim 1 wherein the plurality of connectors are relatively equidistant from one another and relatively perpendicular to one another.

5. The device of claim 1 wherein the device is connectable to one or more other devices via their respective plurality of connectors.

6. An electrical connective device for use in electronic circuits, the device comprising:

(a) a container;
(b) a plurality of connectors;
(c) each of the plurality of connectors having a first portion, each first portion being one of a male connection or a female connection;
(d) each of the plurality of connectors having a second portion, each second portion being the other one of a male connection or a female connection, each second portion configured to connect directly to a first portion;
(e) each of the plurality of connectors having a body portion;
(f) the container enclosing the body portions;
(g) the first portions extending beyond a boundary of the container;
(h) the second portions extending to be flush with the boundary of the container;
(i) electrical circuitry being connected to the body portions of at least two of the plurality of connectors;
(j) the electrical circuitry being a capacitor;
(k) the container being round;
(l) the plurality of connectors being relatively equidistant from one another and relatively perpendicular to one another;
(m) the device is connectable to one or more other devices via their respective plurality of connectors such that the devices are stacked.

7. An electrical connective device for use in electronic circuits, the device comprising:

a container;
a plurality of connectors;
each of the plurality of connectors having a male end;
each of the plurality of connectors having a female end;
each of the plurality of connectors having a joining portion;
the container enclosing the joining portions;
the container being shaped as a relatively round disc;
the container having a first face and an opposite second face;
the male end extending beyond a boundary of the container's first face;
the female end being flush with a boundary of the container's second face;
electrical circuitry being connected between the joining portions of at least two of the plurality of connectors;
the electrical circuitry being a capacitor;
the plurality of connectors being relatively equidistant from one another and relatively perpendicular to one another;
the container is stackable to one or more other containers via their respective plurality of connectors with the male ends being inserted into the female ends.

8. The device of claim 7 wherein the capacitor is of a capacitance selected from a group consisting of 2.5 microfarads, 5 microfarads, 10 microfarads, 15 microfarads, 20 microfarads, and 40 microfarads.

* * * * *